US009208940B2

(12) United States Patent
Kawashima

(10) Patent No.: US 9,208,940 B2
(45) Date of Patent: Dec. 8, 2015

(54) WINDING STRUCTURE, COIL WINDING, COIL PART, AND COIL WINDING MANUFACTURING METHOD

(71) Applicant: SUMIDA CORPORATION, Chuo-ku, Tokyo (JP)

(72) Inventor: Hiroshi Kawashima, Tokyo (JP)

(73) Assignee: SUMIDA CORPORATION (JP)

( * ) Notice: Subject to any disclaimer, the term of this patent is extended or adjusted under 35 U.S.C. 154(b) by 0 days.

(21) Appl. No.: 14/090,994

(22) Filed: Nov. 26, 2013

(65) Prior Publication Data

US 2014/0152415 A1 Jun. 5, 2014

(30) Foreign Application Priority Data

Dec. 5, 2012 (JP) ..... 2012-266621

(51) Int. Cl.

| | |
|---|---|
| ***H01F 27/29*** | (2006.01) |
| ***H01F 27/28*** | (2006.01) |
| ***H01F 21/02*** | (2006.01) |
| ***H01F 41/06*** | (2006.01) |

(52) U.S. Cl.

CPC ..... *H01F 27/29* (2013.01); *H01F 27/2847* (2013.01); *H01F 41/0604* (2013.01); *H01F 41/065* (2013.01)

(58) Field of Classification Search

CPC . H01F 27/2847; H01F 27/29; H01F 27/2852; H01F 41/065; H01F 41/0604

USPC ..... 336/220, 192, 147, 182

See application file for complete search history.

(56) References Cited

U.S. PATENT DOCUMENTS

| | | | | |
|---|---|---|---|---|
| 3,611,233 | A * | 10/1971 | Haldeman, Jr. | 336/188 |
| 2009/0153284 | A1* | 6/2009 | Chen | 336/220 |
| 2011/0156853 | A1* | 6/2011 | Kato et al. | 336/192 |
| 2011/0279208 | A1 | 11/2011 | Ono | |
| 2011/0279210 | A1 | 11/2011 | Ono | |
| 2012/0124821 | A1 | 5/2012 | Lungu | |
| 2013/0333432 | A1 | 12/2013 | Honda | |

FOREIGN PATENT DOCUMENTS

| | | | |
|---|---|---|---|
| EP | 0371933 | A1 | 11/1989 |
| EP | 1271574 | A1 | 6/2001 |
| EP | 2251959 | A1 | 11/2010 |
| EP | 2387048 | A2 | 11/2011 |
| EP | 2387049 | A1 | 11/2011 |
| FR | 2609205 | A1 | 7/1988 |
| JP | 60091603 | A | 5/1985 |
| JP | 07-220928 | A | 8/1995 |
| JP | 10-172852 | B2 | 6/1998 |

(Continued)

OTHER PUBLICATIONS

Extended European Search Report of the International Application No. 13005501.5-1556, mailed on May 26, 2014.

(Continued)

*Primary Examiner* — Mangtin Lian

(74) *Attorney, Agent, or Firm* — Cantor Colburn LLP

(57) ABSTRACT

There is provided a winding structure, a coil winding, a coil part, and a coil winding manufacturing method, which are capable of preventing occurrence of an extra space due to existence of a connecting wire part when two winding parts and a connecting wire part connecting the winding parts are formed.

9 Claims, 18 Drawing Sheets

(56) References Cited

FOREIGN PATENT DOCUMENTS

| | | | |
|---|---|---|---|
| JP | 2004055920 | A | 2/2004 |
| JP | 2005057113 | A | 3/2005 |
| JP | 2006294997 | A | 10/2006 |
| JP | 2008187868 | A | 8/2008 |
| JP | 2008277606 | A | 11/2008 |
| JP | 2009129961 | A | 6/2009 |
| JP | 2010206029 | A | 9/2010 |
| JP | 2011243661 | A1 | 12/2011 |
| JP | 2011243663 | A | 12/2011 |
| JP | 2013258306 | A | 12/2013 |
| JP | 2014039008 | A | 2/2014 |
| WO | 2010021113 | A1 | 2/2010 |

OTHER PUBLICATIONS

Japanese Notice of Reasons for Rejection corresponding to Application No. 2012-266621; Date of Mailing: Dec. 16, 2014, with English translation.

* cited by examiner

WINDING STRUCTURE, COIL WINDING, COIL PART, AND COIL WINDING MANUFACTURING METHOD

The present invention claims priority under 35 U.S.C. §119 to Japanese Application No. 2012-266621 filed Dec. 5, 2012, the entire content of which is incorporated herein by reference.

BACKGROUND OF THE INVENTION

1. Field of the Invention

The present invention relates to a winding structure, a coil winding, a coil part, and a coil winding manufacturing method.

2. Description of the Related Art

In a drive unit for driving wheels of an automobile with a power generator which utilizes natural energy, a power supply device, and a motor, a coil part (reactor) is used in an electric circuit in order to improve power efficiency and remove noise. In such a coil part, for the purpose of corresponding to large electric current and improving a space factor, a flat wire is generally used. Patent Document 1 describes a coil part using such a flat wire.

[Patent Document 1] Japanese Patent No. 3398855 (see FIG. 4 to FIG. 6)

SUMMARY OF THE INVENTION

In the structure of Patent Document 1, a twisted portion exists in a part (connecting wire part) between a first winding part (first coil part) and a second winding part (second coil part), and the winding parts are provided so that an electric current flowing through the flat wire is inverted between the first winding part and the second winding part by this twisted portion.

Here, FIG. 15 illustrates a plan view of a coil winding 20P in which a twisted portion similar to that of Patent Document 1 exists. Further, FIG. 16 illustrates a partial side view of a coil part 10P in which the twisted portion exists. When the twisted portion 25P as illustrated in FIG. 15 exists, an extra space approximately equal to the width of a flat wire H is needed in an inside (ring hole 30P) of a ring-shaped core 31P, as illustrated in FIG. 16. Dimensions of the coil part 10P become large by that such an extra space is needed, which hinders miniaturization of the coil part 10P.

The present invention is made in view of such problems, and it is an object thereof to provide a winding structure, a coil winding, a coil part, and a coil winding manufacturing method, which are capable of preventing occurrence of an extra space due to existence of a connecting wire part when a flat wire is processed to form two winding parts and a connecting wire part connecting the winding parts.

To solve the above-described problem, one aspect of a winding structure of the present invention has: a first winding part formed by winding a flat wire; a second winding part formed by winding the flat wire continuing to the first winding part, the second winding part being wound in a same winding direction as a winding direction of the first winding part; and a part to be connecting wire located between the first winding part and the second winding part to connect the winding parts, wherein the part to be connecting wire has: an interval defining portion defining an interval between the first winding part and the second winding part; a first coupling portion with one end side continuing to the interval defining portion and another end side continuing to the first winding part on one side in an axial direction of the first winding part; and a second coupling portion with one end side continuing to the interval defining portion and another end side continuing to the second winding part on another side in an axial direction of the second winding part, and at least one of the first coupling portion and the second coupling portion becomes a twisted portion by twisting by approximately 180 degrees in total.

Further, in another aspect of the winding structure of the present invention, in addition to the above-described invention, preferably, numbers of windings of the first winding part and the second winding part are equal.

Moreover, in another aspect of the winding structure of the present invention, in addition to the above-described invention, preferably, the first coupling portion and the second coupling portion continue to the interval defining portion by forming an edgewise bending in a same direction as a winding direction of the first winding part, and either one of the first coupling portion and the second coupling portion becomes a twisted portion by twisting by approximately 180 degrees.

Further, in another aspect of the winding structure of the present invention, in addition to the above-described invention, preferably, extending directions of the first coupling portion and the second coupling portion are same as an extending direction of the interval defining portion, and both the first coupling portion and the second coupling portion become a twisted portion by twisting each by approximately 90 degrees in a same direction.

Moreover, in another aspect of the winding structure of the present invention, in addition to the above-described invention, preferably, a first terminal on a side opposite to the first coupling portion in the first winding part and a second terminal on a side opposite to the second coupling portion in the second winding part have front end sides extending in a same direction.

Further, in another aspect of the winding structure of the present invention, in addition to the above-described invention, preferably, a first terminal on a side opposite to the part to be connecting wire in the first winding part and a second terminal on a side opposite to the part to be connecting wire in the second winding part have front end sides extending in opposite directions from each other.

Moreover, preferably, a coil winding which is another invention of the present invention uses the above-described winding structure, wherein a boundary portion between the first coupling portion and the first winding part is bent so that the first coupling portion extends in a direction to depart from the first winding part, a boundary portion between the second coupling portion and the second winding part is bent so that the second coupling portion extends in a direction to depart from the second winding part, and a connecting wire part is formed from the part to be connecting wire by the bending of the boundary portions.

Further, preferably, a coil winding which is another invention of the present invention uses the above-described winding structure, wherein a boundary portion between the first coupling portion and the first winding part is bent so that the first coupling portion extends in a direction to depart from the first winding part, a boundary portion between the second coupling portion and the second winding part is bent so that the second coupling portion extends in a direction to depart from the second winding part, a boundary portion between the first coupling portion and the interval defining portion and a boundary portion between the second coupling portion and the interval defining portion are bent so that the first winding part and the second winding part are located on a same side in the axial direction, and a connecting wire part is formed from the part to be connecting wire by the bending of the boundary portions.

Moreover, in another aspect of the coil winding of the present invention, in addition to the above-described invention, preferably, the first terminal on a side opposite to the connecting wire part in the first winding part and the second terminal on a side opposite to the connecting wire part in the second winding part have front end sides extending in a same direction, and one of the first terminal and the second terminal is located on a facing portion side where the first winding part and the second winding part face each other, and the other of the first terminal and the second terminal is located on an outer peripheral side where the first winding part and the second winding part do not face each other.

Further, preferably, a coil part which is another invention of the present invention has the above-described coil winding and a core body formed from a magnetic material, provided in a ring shape, and inserted through a center hole of the first winding part and a center hole of the second winding part.

Moreover, preferably, a coil winding manufacturing method which is another invention of the present invention is a coil winding manufacturing method for forming a coil winding from a flat wire, the method including: a first winding step of winding the flat wire to form a first winding part; a second winding step of winding the flat wire in a same winding direction as a winding direction of the first winding part to form a second winding part; a part to be connecting wire forming step of forming, after the first winding step and before the second winding step, a part to be connecting wire having an interval defining portion defining an interval between the first winding part and the second winding part, a first coupling portion with one end side continuing to the interval defining portion and another end side continuing to the first winding part on one side in an axial direction of the first winding part, and a second coupling portion with one end side continuing to the interval defining portion and another end side continuing to the second winding part on another side in an axial direction of the second winding part, a twisted portion forming step of twisting, by approximately 180 degrees in total, at least one of the first coupling portion and the second coupling portion after the part to be connecting wire forming step; and a connecting wire part forming step of bending a boundary portion between the first coupling portion and the first winding part and bending a boundary portion between the second coupling portion and the second winding part, to thereby form a connecting wire part from the part to be connecting wire.

According to the present invention, it becomes possible to provide a winding structure, a coil winding, a coil part, and a coil winding manufacturing method, which are capable of preventing occurrence of an extra space due to existence of a connecting wire part when a flat wire is processed to form two winding parts and a connecting wire part connecting the winding parts.

DETAILED DESCRIPTION OF THE PREFERRED EMBODIMENT

Figure 1:
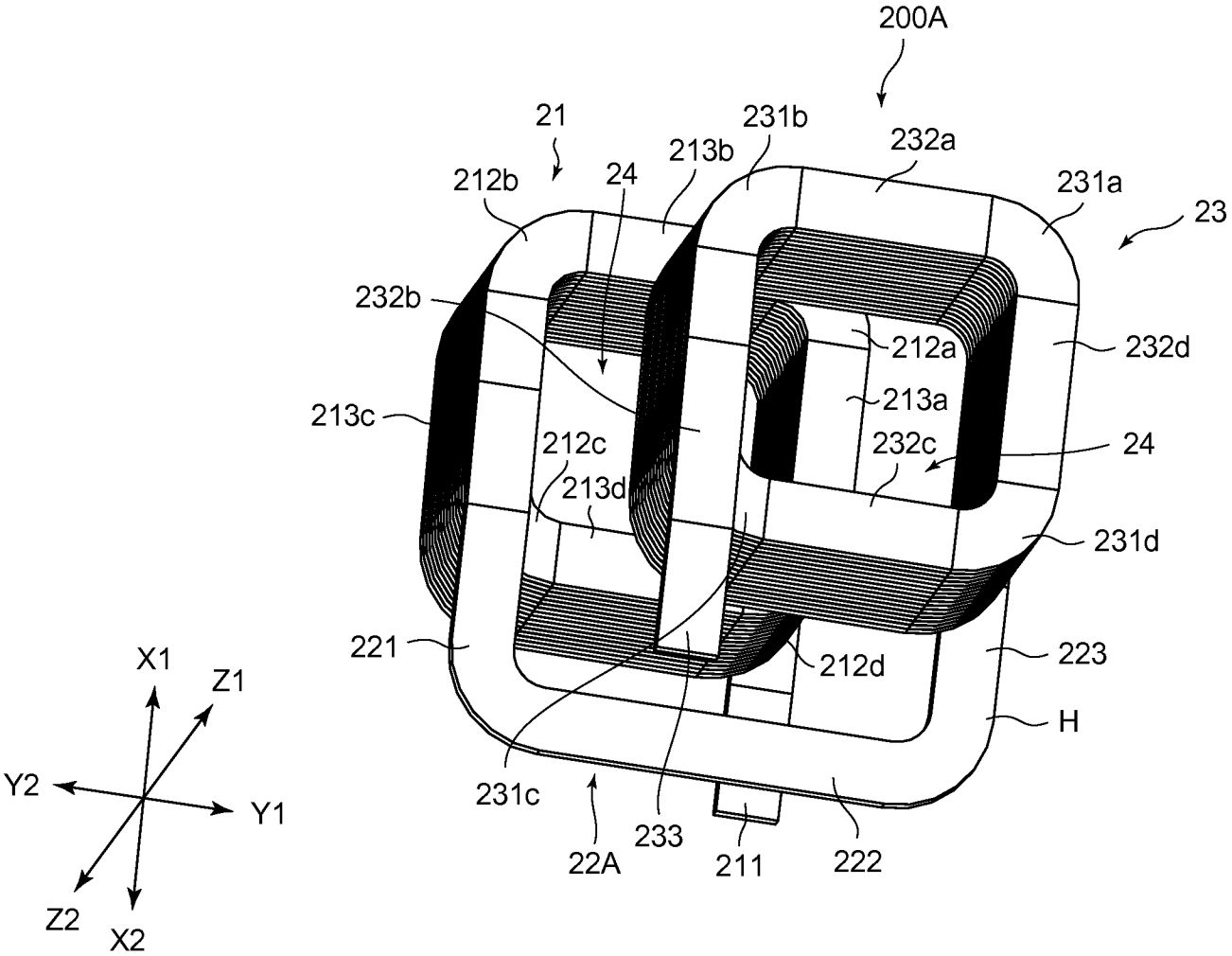
FIG. 1 is a perspective view illustrating a shape of a winding structure according to one embodiment of the present invention.

Hereinafter, a coil part 10 (coil part 10A, 10B; see FIG. 13 and FIG. 14) according to one embodiment of the present invention will be described based on the drawings. Note that in the following description, manufacturing processes are described together when a coil winding 20 (coil winding 20A, 20B; see FIG. 6 and FIG. 8) of a coil part 10 is described.

Note that in the following description, an axial direction of the coil winding 20 and a winding structure 200 is denoted as Z direction, a side facing toward a connecting wire part 22 (part to be connecting wire 22A, which will be described later) from a terminal portion 211 (which will be described later) in the Z direction is denoted as Z1 side, and an opposite side thereof is denoted as Z2 side. Further, a direction in which a terminal portion 233 and the terminal portion 211 extend is denoted as X direction, a side where the terminal portion 211 projects (see FIG. 2 and the like) with respect to a first winding part 21 (which will be described later) is denoted as X2 side, and the opposite side thereof is denoted as X1 side. Further, in the coil winding 20 illustrated in FIG. 6 and FIG. 8 and the coil part 10 illustrated in FIG. 13 and FIG. 14, a direction orthogonal to the X direction and the Z direction is denoted as Y direction, a side where a second winding part 23 is located with respect to the first winding part 21 is denoted as Y2 side, and the opposite side thereof is denoted as Y1 side.

Further, in the following description, when it is unnecessary to distinguish the coil parts 10A, 10B from each other, they are referred to as a coil part 10. Also when it is unnecessary to distinguish coil windings 20A to 20D from each other, they are referred to as a coil winding 20. Similarly, when it is unnecessary to distinguish winding structures 200A, 200B from each other, they are referred to as a winding structure 200.

<Regarding Formation of a Winding Structure 200A>

First, formation of a winding structure 200A during manufacturing of the coil winding 20 will be described.

Figure 2:
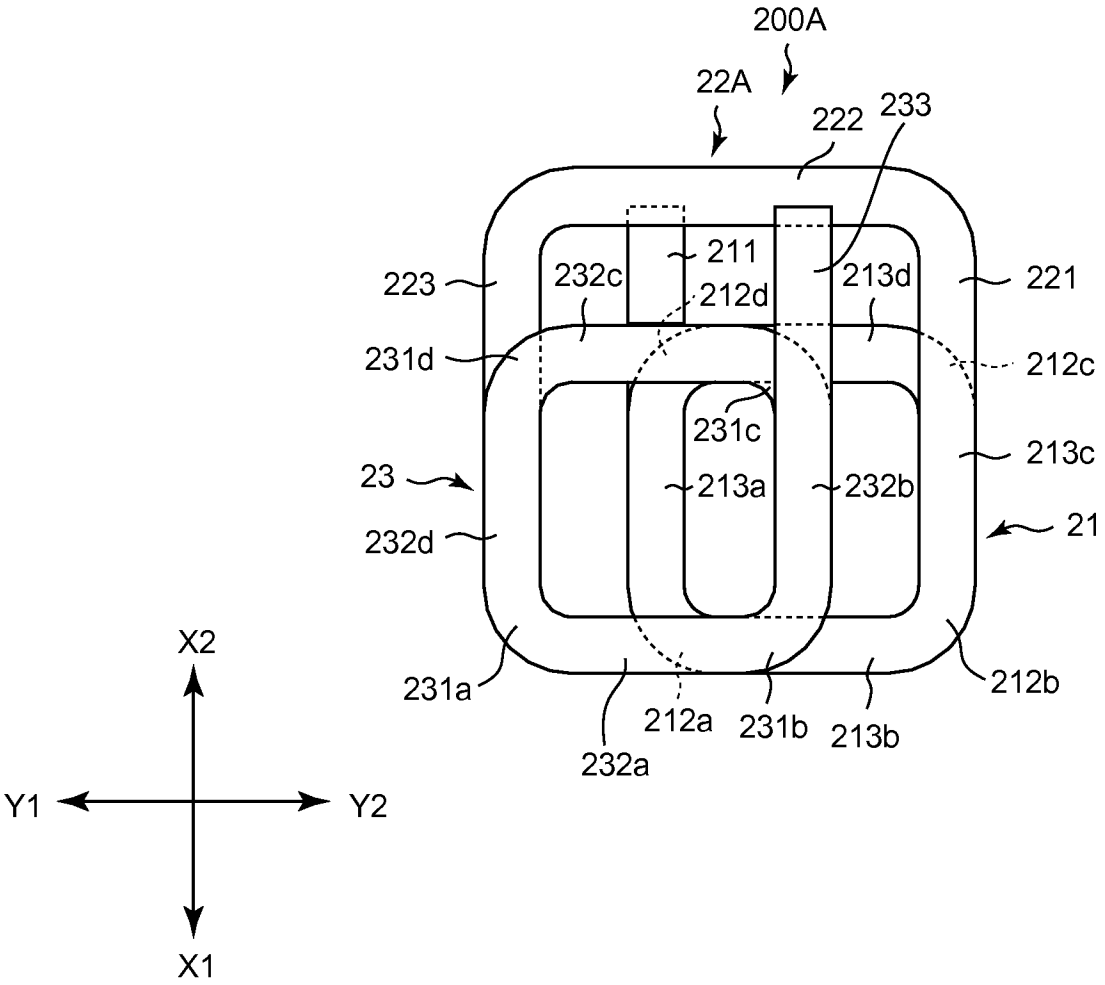
FIG. 2 is a plan view illustrating the shape of the winding structure of FIG. 1.

FIG. 1 is a perspective view illustrating the winding structure 200A. FIG. 2 is a plan view illustrating the winding structure 200A. This winding structure 200A has a first winding part 21, a part to be connecting wire 22A, and a second winding part 23.

Figure 3A:
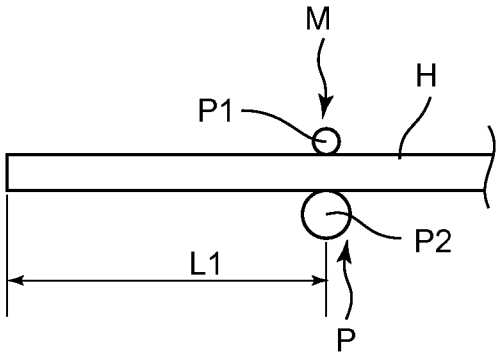
FIGS. 3A and 3B illustrate a manufacturing method of the winding structure, FIG. 3A being a diagram illustrating a state that a flat wire before being bent is fed by a length L1, FIG. 3B being a diagram illustrating a state that the flat wire fed by the length L1 is bent.

When the winding structure 200A as illustrated in FIG. 1 and FIG. 2 is formed, first, a flat wire H is pulled off a supply source where the flat wire H is wound, such as a bobbin or reel, and the flat wire H is set to a bending machine (omitted from the illustrations). Thereafter, as illustrated in FIG. 3A, a feeding unit (omitted from the illustrations) of the bending machine is activated to feed the flat wire H by a predetermined length L1.

At this time, the flat wire H is fed by a length L1 of the sum of the terminal portion 211 and a straight portion 213*a* in the first winding part 21 of FIG. 1, which will be described later, and by this feeding, a portion corresponding to a bent portion 212*a* in FIG. 1 is located at a bending part M of the bending machine illustrated in FIG. 3A. At the bending part M, an inner jig P1 and an outer jig P2 are disposed, which constitute a processing unit P of the bending machine. The inner jig P1 is disposed on an inner peripheral side when bending of the flat wire H is performed, and the outer jig P2 is disposed on an outer peripheral side when bending of the flat wire H is performed.

Figure 3B:
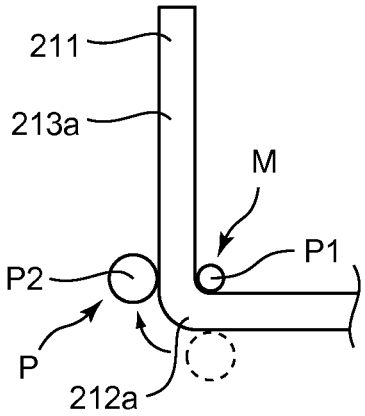

When the processing unit P of the bending machine is then activated, as illustrated in FIG. 3B, bending of the flat wire H is performed so that the flat wire H follows an outer peripheral surface of the inner jig P1. In this bending, a longitudinal (extending) direction and a width direction of the flat wire H are bent by approximately 90 degrees, but a thickness direction of the flat wire H is in a barely changed (bent) state. By this bending, the terminal portion 211 (corresponding to a first terminal) and the straight portion 213*a* in the first winding part 21 illustrated in FIG. 1 and FIG. 2 are formed in an integrated state. Note that in the following description, "approximately 90 degrees" include just 90 degrees or an angle equivalent to 90 degrees.

Thereafter, feeding of the flat wire H by actuation of the feeding unit of the bending machine and bending by actuation of the processing unit P of the bending machine are performed sequentially in a similar manner Thus, the first winding part 21 is formed which is wound in a rectangular shape (what is called an edgewise winding) and has four bent portions 212*a* to 212*d* and four straight portions 213*a* to 213*d* (corresponding to a first winding step).

Figure 4A:
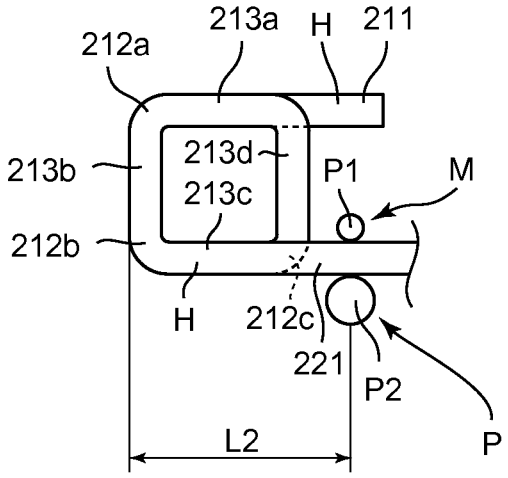
FIGS. 4A and 4B illustrate the manufacturing method of the winding structure, FIG. 4A being a diagram illustrating a state that the flat wire is fed by a length L2 corresponding to a first coupling portion of a part to be connecting wire, FIG. 4B being a diagram illustrating a state that the flat wire is fed by a length L3 corresponding to an interval defining portion of a part to be connecting wire.

After the first winding part 21 is formed, the feeding unit of the bending machine is actuated to feed a length L2 of the sum of the straight portion 213*c* and a first coupling portion 221 of the part to be connecting wire 22A, continuing from the bent portion 212*b* as illustrated in FIG. 4A. At this time, the end of the fed portion is positioned at the bending part M. Thereafter, the processing unit P of the bending machine is actuated to bend the flat wire H. The direction of edgewise bending at this time is the same as that when the first winding part 21 is formed. Thus, the first coupling portion 221 continuing to the straight portion 213*c* of the first winding part 21 is formed.

Figure 4B:
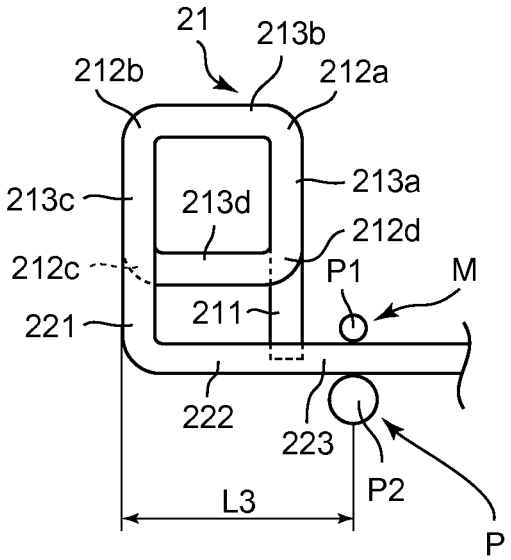

Further, after the first coupling portion 221 is formed, the feeding unit of the bending machine is actuated to feed the flat wire H by a length L3 corresponding to an interval defining portion 222, as illustrated in FIG. 4B. Then, the end of the fed portion is positioned at the bending part M. Thereafter, the processing unit P of the bending machine is actuated to bend the flat wire H. The direction of edgewise winding at this time is the same direction as that when the first winding part 21 is formed. Thus, the interval defining portion 222 continuing to the first coupling portion 221 is formed.

Figure 5A:
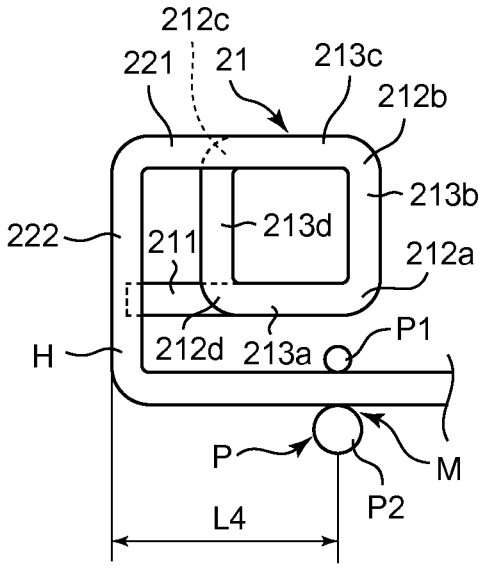
FIGS. 5A and 5B illustrate the manufacturing method of the winding structure, FIG. 5A being a diagram illustrating a state that a length L4 of the sum of a length corresponding to a second coupling portion and a straight portion of the second winding part is fed, FIG. 5B being a diagram illustrating a state that the fed flat wire is bent.
Figure 5B:
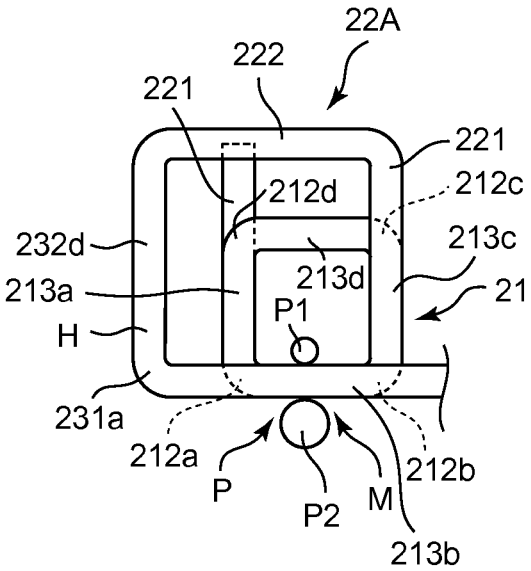

Next, after the interval defining portion 222 is formed, as illustrated in FIG. 5A, the feeding unit of the bending machine is actuated to feed a length L4 of the sum of a length corresponding to a second coupling portion 223 (the length of the second coupling portion 223 is equal to that of the first coupling portion 221) and a straight portion 232*d* of the second winding part 23, and a portion corresponding to a bent portion 231*a* of the second winding part 23 is positioned at the bending part M of the bending machine. Then, the processing unit of the bending machine is actuated to bend the flat wire H. The direction of edgewise winding at this time is the same direction as that when the first winding part 21 is formed. Thus, as illustrated in FIG. 5B, the second coupling portion 223 and the straight portion 232*d* are formed in an integrated state.

Note that the first coupling portion 221, the interval defining portion 222, and the second coupling portion 223 constitute the part to be connecting wire 22A connecting the first winding part 21 and the second winding part 23. The part to be connecting wire 22A is a part which becomes a connecting wire part 22 by undergoing bending, or bending and twisting, as will be described later. Further, a step of forming the part to be connecting wire 22A in this manner corresponds to a part to be connecting wire forming step.

Thereafter, feeding of the flat wire H by actuation of the feeding unit of the bending machine and bending by actuation of the processing unit of the bending machine are performed sequentially in a manner similar to the formation of the first winding part 21. Thus, the second winding part 23 is formed which is wound in a rectangular shape (what is called an edgewise winding) and has four bent portions 231*a* to 231*d* and four straight portions 232*a* to 232*d* (corresponding to a second winding step). Note that the direction of edgewise winding when the second winding part 23 is formed is the same direction as that when the first winding part 21 is formed.

Note that when the last bending of the second winding part 23 is performed, the terminal portion 233 (corresponding to a second terminal) and the straight portion 232*b* in the second winding part 23 are formed in an integrated state. Thus, the winding structure 200A as illustrated in FIG. 1 and FIG. 2 is formed.

<Regarding Formation of the Coil Winding 20>

Figure 6:
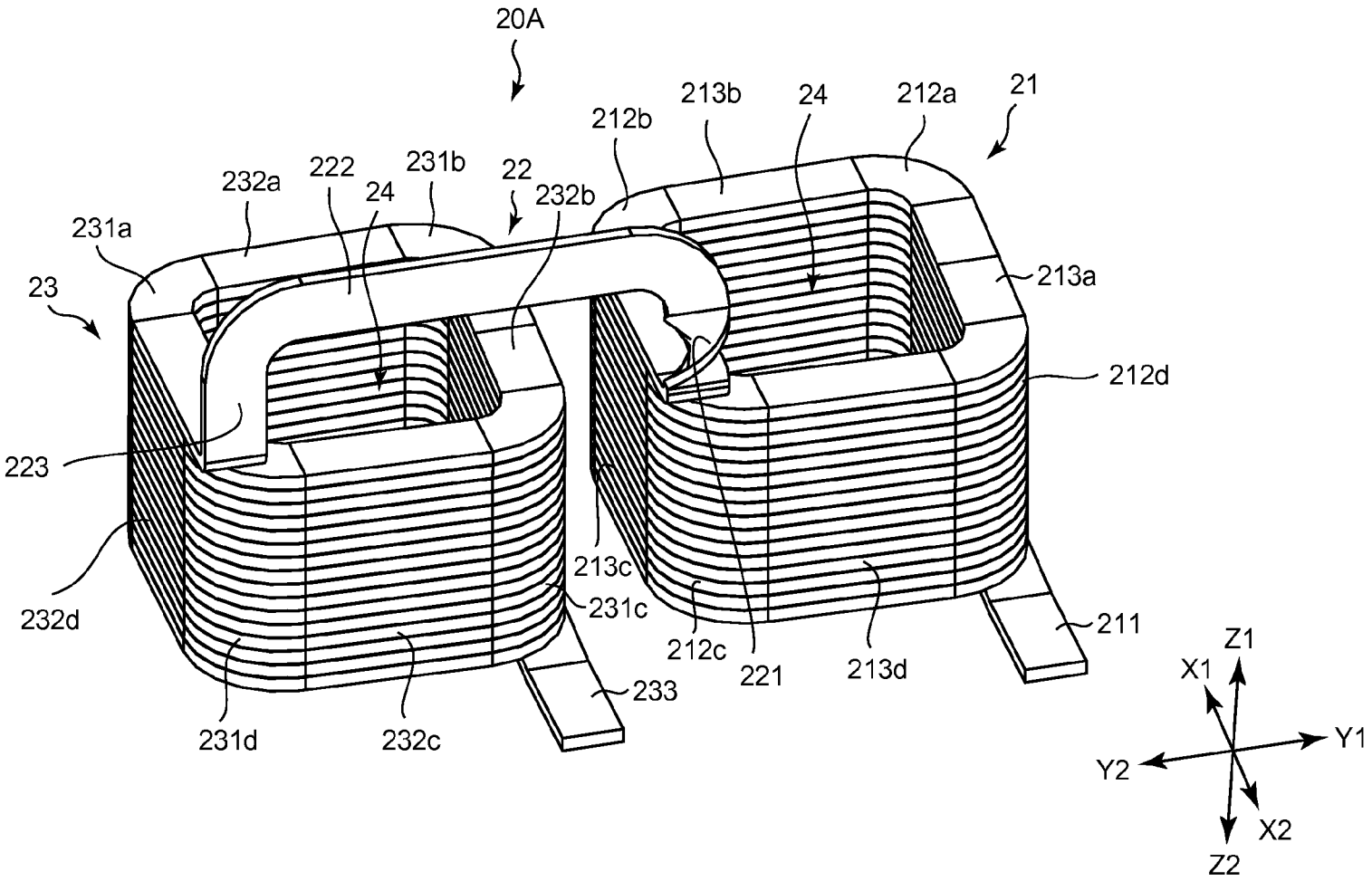
FIG. 6 is a perspective view illustrating a shape of a coil winding formed from the winding structure of FIG. 1.
Figure 8:
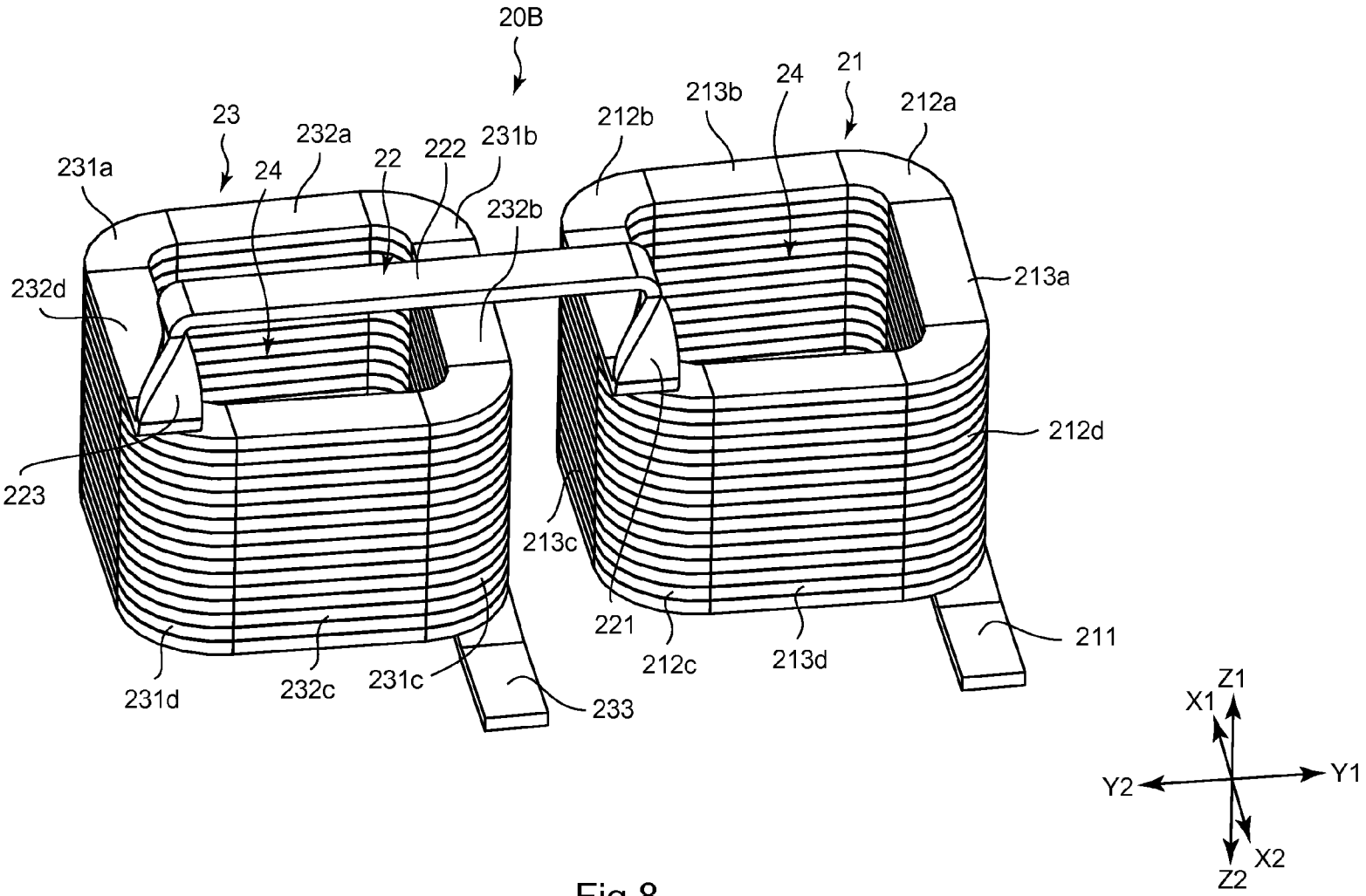
FIG. 8 is a perspective view illustrating a shape of a coil winding formed from a winding structure different from the winding structure of FIG. 1.

Next, formation of the coil winding 20 will be described. From the winding structure 200A, a coil winding 20A as illustrated in FIG. 6 is formed. Further, from a winding structure 200B which will be described later, a coil winding 20B as illustrated in FIG. 8 is formed.

(Regarding Formation of the Coil Winding 20A of the Type Illustrated in FIG. 6)

Figure 7A:
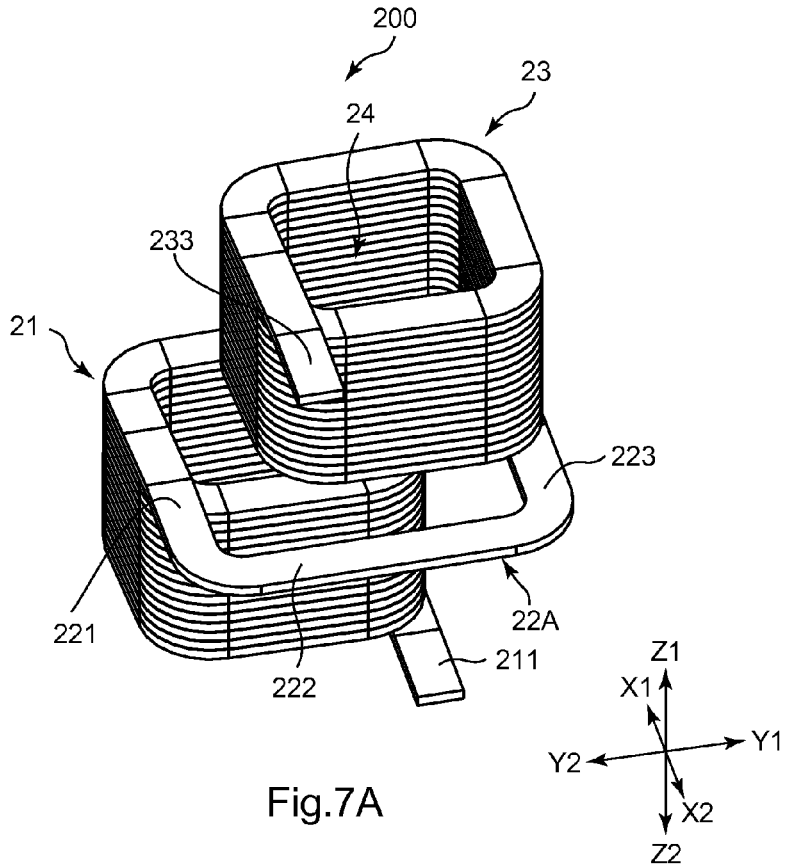
FIGS. 7A and 7B are perspective views illustrating middle stages when the coil winding illustrated in FIG. 6 is produced.
Figure 7B:
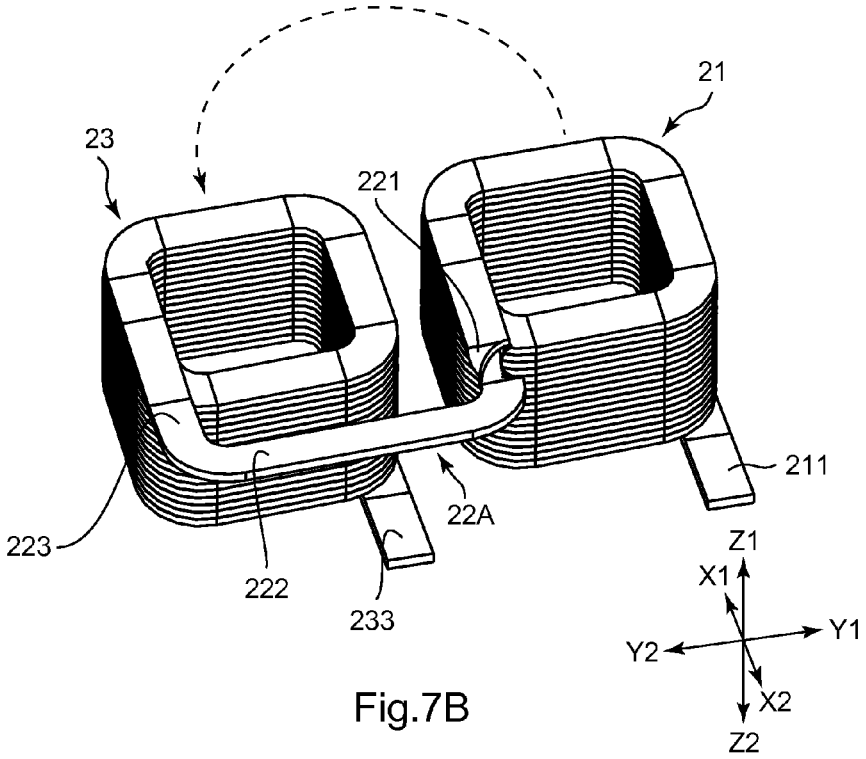

First, the case of forming the coil winding 20A of the type illustrated in FIG. 6 will be described. When the coil winding 20A of the type illustrated in FIG. 6 is formed, the first coupling portion 221 is twisted by approximately 180 degrees as illustrated in FIGS. 7A and 7B. Here, as illustrated in FIG. 1 and FIG. 7A, in a state before the first coupling portion 221 is twisted, the second winding part 23 is located on a winding end side of the first winding part 21 (Z1 side), and they are disposed by stacking on one another. Accordingly, when the first coupling portion 221 is twisted, it is twisted in a direction not causing interference between the first winding part 21 and the second winding part 23.

To twist in such a direction not causing interference, when the X1 side is seen from the X2 side in FIG. 7A, the second winding part 23 is twisted by approximately 180 degrees counterclockwise with respect to the first winding part 21. Thus, as illustrated in FIG. 7B, a twisted portion is formed in the first coupling portion 221 (corresponding to a twisted portion forming step).

Subsequently, a boundary portion of the first coupling portion 221 with respect to the first winding part 21 and a boundary portion of the second coupling portion 223 with respect to the second winding part 23 are bent. At this time, the two boundary portions may be bent separately. However, as can be seen from FIG. 7B, the two boundary portions to be bent are located on the X2 side of the first winding part 21 and the second winding part 23. Accordingly, the two boundary portions may be bent simultaneously.

In this manner, when the boundary portions are bent, the coil winding 20A as illustrated in FIG. 6 is formed from the winding structure in which the twisted portion is formed in the part to be connecting wire 22A as illustrated in FIG. 7B. Further, such a step of bending corresponds to a connecting wire part forming step. Thus, the connecting wire part 22 formed from the part to be connecting wire 22A is provided in a state of standing up with respect to the first winding part 21 and the second winding part 23.

Note that when the boundary portion between the first coupling portion 221 and the first winding part 21 and the boundary portion between the second coupling portion 223 and the second winding part 23 are bent, they may be bent by approximately 90 degrees with respect to the flat wire H constituting the first winding part 21 and the second winding part 23. However, a front surface and a rear surface of the flat wire H constituting the first winding part 21 and the second winding part 23 are not in parallel with the XY plane, but form an angle corresponding to the amount of thickness of the flat wire H on the XY plane. Accordingly, the above-described bending of the boundary portions by approximately 90 degrees may be bending so as to form approximately 90 degrees with respect to the XY plane. This point will be the same in the case of bending the boundary portion between the first coupling portion 221 and the first winding part 21 and the case of bending the boundary portion between the second coupling portion 223 and the second winding part 23 in FIG. 8, FIGS. 11A and 11B, and the like, as will be described later.

By bending as described above, the coil winding 20 as illustrated in FIG. 6 is formed.

(Regarding Formation of the Coil Winding 20B Illustrated in FIG. 8)

Next, the case of forming the coil winding 20B as illustrated in FIG. 8 will be described.

When the coil winding 20B as illustrated in FIG. 8 is formed, a winding structure 200B different from the winding structure 200A illustrated in FIG. 1 is used. In the winding structure 200A illustrated in FIG. 1, portions where edgewise bending is performed exist in the part to be connecting wire 22A, and the portions where edgewise bending is performed are between the first coupling portion 221 and the interval defining portion 222 and between the interval defining portion 222 and the second coupling portion 223.

However, in the coil winding 20B illustrated in FIG. 8, the portions where edgewise bending is performed do not exist in the connecting wire part 22, and a boundary portion between the first coupling portion 221 and the interval defining portion 222 and a boundary portion between the interval defining portion 222 and the second coupling portion 223 are bent. In addition, the first coupling portion 221 and the second coupling portion 223 are twisted by approximately 90 degrees.

Figure 9:
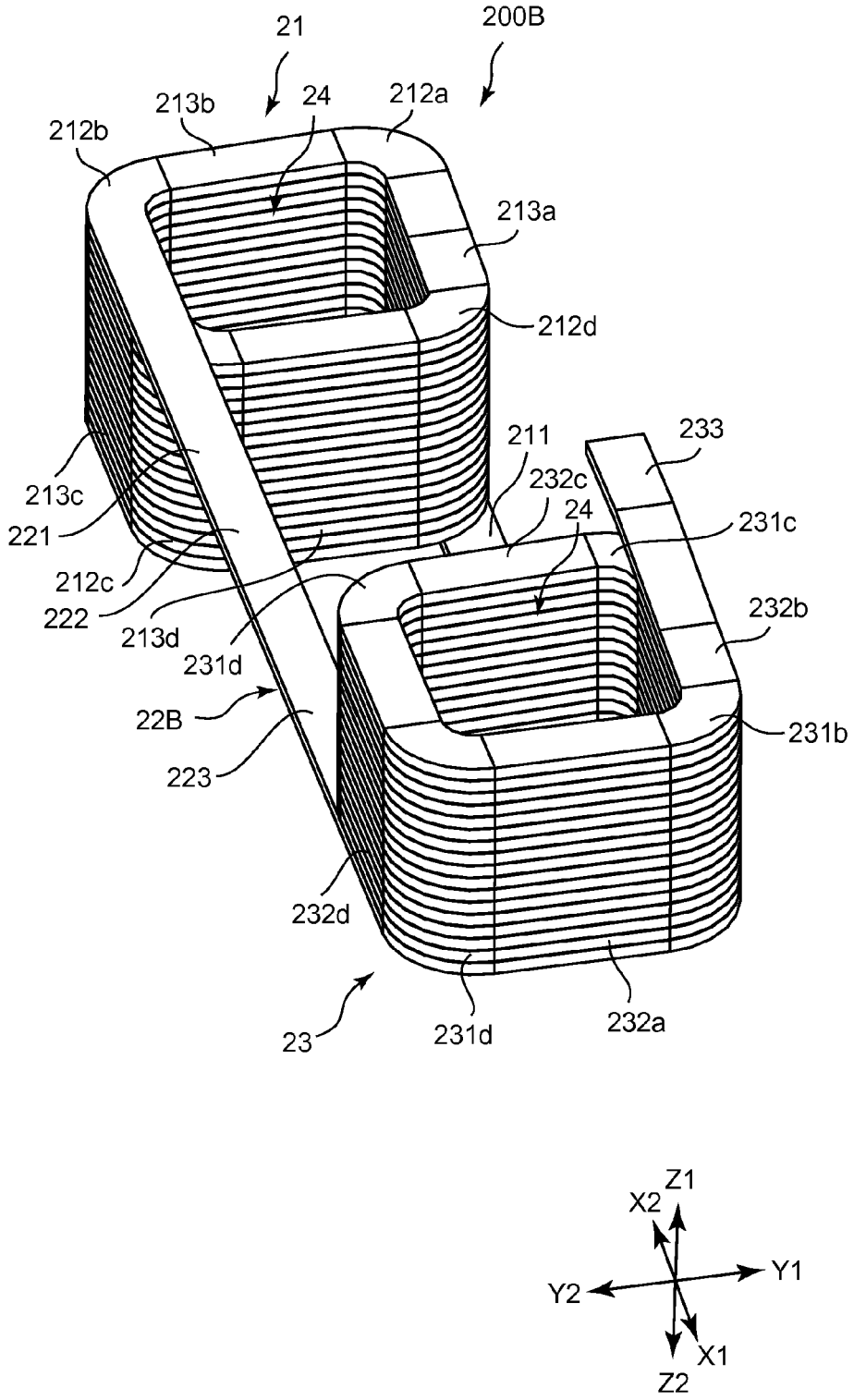
FIG. 9 is a perspective view illustrating a shape of a winding structure for producing the coil winding illustrated in FIG. 8.

The winding structure 200B for forming such a coil winding 20B is illustrated in FIG. 9. As illustrated in FIG. 9, a part to be connecting wire 22B of the winding structure 200B is provided in a linear shape between the first winding part 21 and the second winding part 23. Specifically, the first coupling portion 221, the interval defining portion 222, and the second coupling portion 223 are connected in a linear shape to form the part to be connecting wire 22B. Moreover, the part to be connecting wire 22B extends in the same direction as the straight portion 213*c* and the straight portion 232*d*.

Note that when the winding structure 200B is formed, as compared to the winding structure 200 of FIG. 1, the number of times of edgewise bending is reduced, and the feeding dimension of the flat wire H when the part to be connecting wire 22B is formed (in the part to be connecting wire forming step) is different. However, when the other portions are formed, the winding structure 200B can be formed similarly to the winding structure 200A, and thus descriptions thereof are omitted.

Figure 10B:
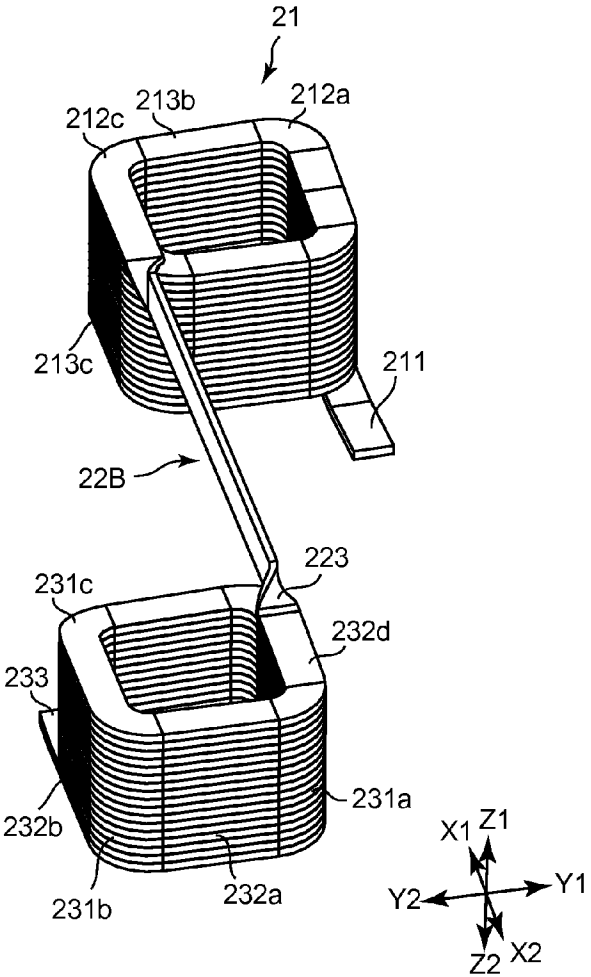
FIGS. 10A and 10B are perspective views illustrating middle stages when the coil winding illustrated in FIG. 8 is produced from the winding structure of FIG. 9, FIG. 10A illustrating a state that the first coupling portion is twisted by 90 degrees, FIG. 10B illustrating a state that the second coupling portion is further twisted by 90 degrees.
Figure 10A:
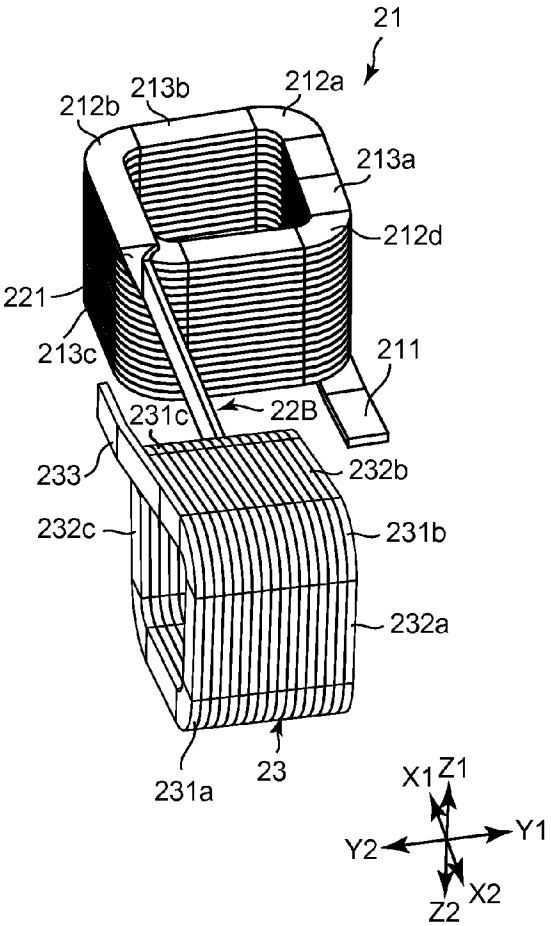

When the coil winding 20B illustrated in FIG. 8 is formed from the winding structure 200B as in FIG. 9 below, first, as illustrated in FIG. 10A, the first coupling portion 221 in the part to be connecting wire 22B is twisted by approximately 90 degrees (corresponding to a twisted part forming step). The direction of twisting at this time is a direction to position the second winding part 23 on the Y2 side with respect to the position before it is twisted, and when the X1 side is seen from the X2 side as in FIG. 10A, the second winding part is twisted counterclockwise.

Here, when the first coupling portion 221 is twisted by approximately 90 degrees, it is necessary to prevent twisting of the interval defining portion 222 and the straight portion 213*c* of the first winding part 21. Accordingly, it is preferred to perform twisting while holding down a boundary portion between the first coupling portion 221 and the straight portion 213*c* and the boundary portion between the interval defining portion 222 and the first coupling portion 221.

Next, as illustrated in FIG. 10B, the second coupling portion 223 in the part to be connecting wire 22B is twisted by approximately 90 degrees (corresponding to the twisted portion forming step). The direction of twisting at this time is a direction to position the second winding part 23 on the Z2 side with respect to the position before it is twisted, and when the X1 side is seen from the X2 side as in FIG. 10B, the second winding part is twisted counterclockwise. Note that by this twisting the position of the second winding part 23 in the Z direction is equivalent to the first winding part 21.

Figure 11A:
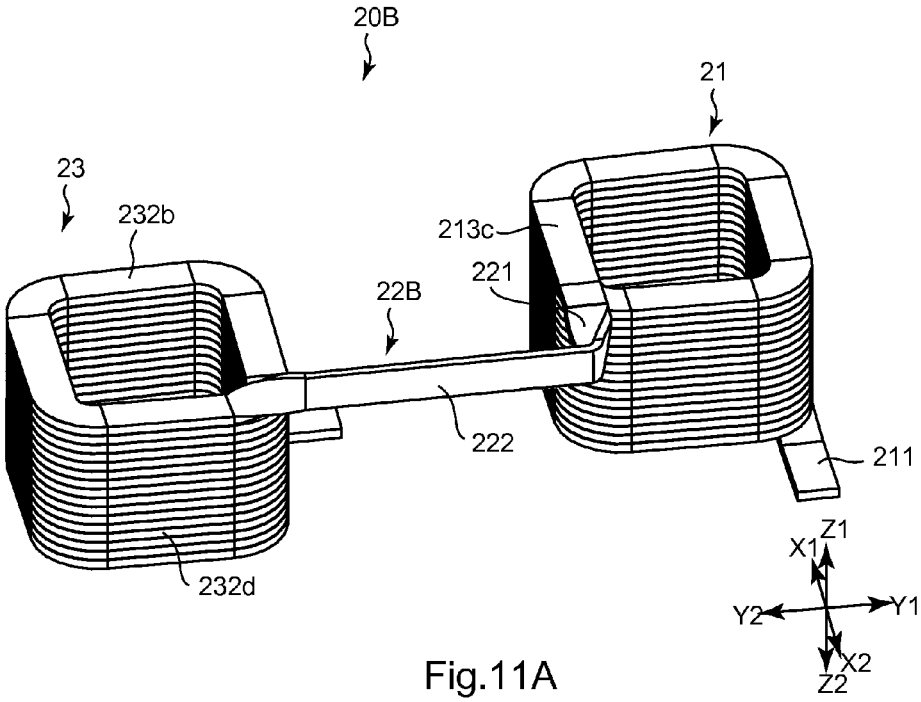
FIGS. 11A and 11B are perspective views illustrating middle stages when the coil winding illustrated in FIG. 8 is produced from the winding structure of FIG. 9, FIG. 11A illustrating a state that a boundary portion between the first coupling portion and the interval defining portion is bent, FIG. 11B illustrating a state that a boundary portion between the second coupling portion and the interval defining portion is further bent.

Next, as illustrated in FIG. 11A, the boundary portion between the first coupling portion 221 and the interval defining portion 222 is bent by approximately 90 degrees. In bending to proceed from FIG. 10B to FIG. 11A, the boundary portion is bent so that the second winding part 23 turns clockwise with respect to the first winding part 21.

Figure 11B:
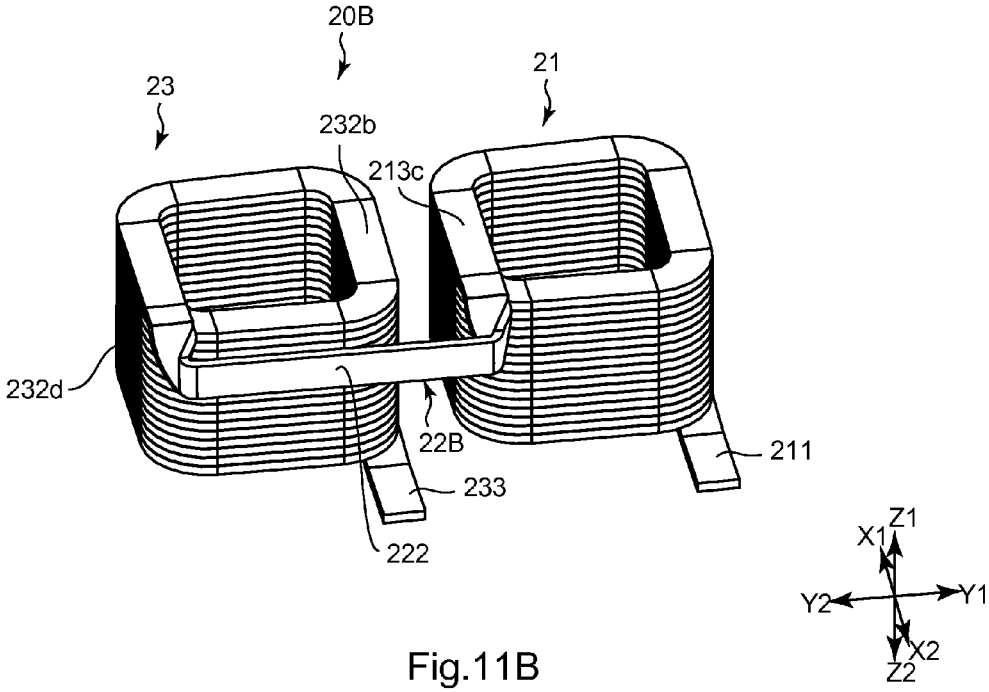

Next, as illustrated in FIG. 11B, the boundary portion between the second coupling portion 223 and the interval defining portion 222 is bent by approximately 90 degrees. In bending to proceed from FIG. 11A to FIG. 11B, the boundary portion is bent so that the second winding part 23 turns clockwise with respect to the first winding part 21.

Next, the boundary portion between the first coupling portion 221 and the straight portion 213*c* and a boundary portion between the second coupling portion 223 and the straight portion 232*d* are bent. Thus, the coil winding 20B as illustrated in FIG. 8 is formed. Note that the step of bending as above corresponds to the part to be connecting wire forming step.

Note that before the first coupling portion 221 as illustrated in FIG. 10A is twisted, the second coupling portion 223 as illustrated in FIG. 10B may be twisted. Further, before the boundary portion between the first coupling portion 221 and the interval defining portion 222 as illustrated in FIG. 11A is bent by approximately 90 degrees, the boundary portion between the second coupling portion 223 and the interval defining portion 222 as illustrated in FIG. 11B may be bent by approximately 90 degrees. Furthermore, before portions where twisting is performed as illustrated in FIGS. 10A, 10B are formed, portions where bending is performed as illustrated in FIGS. 11A, 11B and FIG. 8 may be formed.

Further, bending of the boundary portion between the first coupling portion 221 and the interval defining portion 222 may be, inversely to FIG. 11A, bending of the boundary portion so that the second winding part 23 turns counterclockwise with respect to the first winding part 21. At this time, bending of the boundary portion between the second coupling portion 223 and the interval defining portion 222 is, inversely to FIG. 11B, bending of the boundary portion so that the second winding part 23 turns counterclockwise with respect to the first winding part 21. When such bending is performed, positions of the first winding part 21 and the second winding part 23 are inverted left to right from those illustrated in FIG. 8. However, it is possible to form a coil winding 20 with the other structures being similar to the coil winding 20B.

<Regarding Formation of the Coil Part 10 Using the Coil Winding 20>

Figure 12:
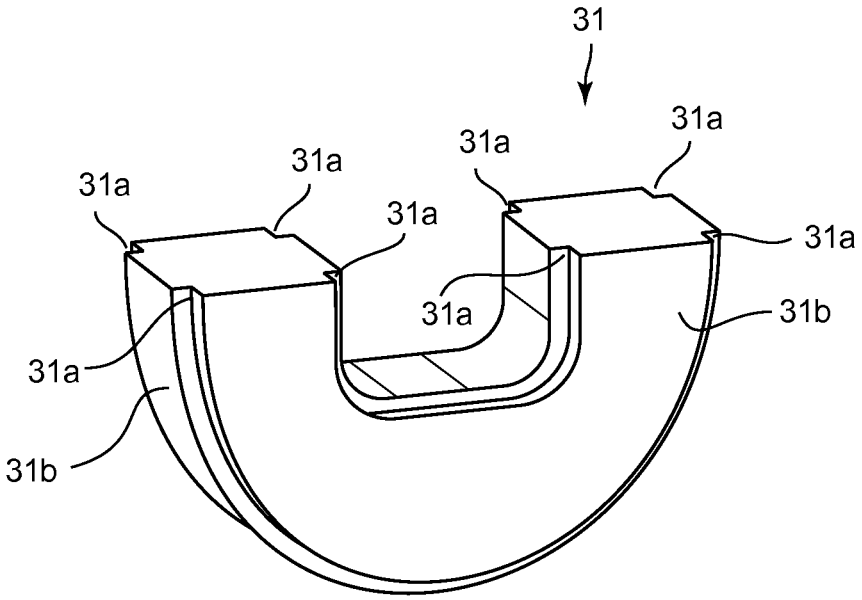
FIG. 12 is a perspective view illustrating a shape of a core constituting a coil part.

When the coil part 10 is formed using the coil winding 20 (coil winding 20A, 20B) as above, a core 31 as illustrated in FIG. 12 is formed separately from formation of the coil winding 20. The core 31 has a U-shape when seen in a side view (what is called a cut core), and a ring-shaped core body 30 (see FIG. 13, FIG. 14) is formed by butting two such cores 31 having a U-shape. Note that in the following, a hole located on a center side of the ring-shaped core body 30 will be referred to as a ring hole 30A.

The core 31 is formed from a magnetic material, and such a magnetic material may be a stack of silicon steel plates as well as a metal magnetic material such as iron-based material, permalloy, sendust, amorphous metal, or the like, or an oxide magnetic material. However, a mixture of these magnetic materials may be used, or a composite material of these magnetic materials may be used.

As illustrated in FIG. 12, in this embodiment, the core 31 is provided to have the following cross-sectional shape. Specifically, it is provided to have a shape in which cutout parts 31*a* exist by cutting out four corners of a rectangle by a small rectangle. Existence of such cutout parts 31*a* enables to prevent interference of the bent portions 212*a* to 212*d* of the first winding part 21 and the bent portions 231*a* to 231*d* of the second winding part 23 with the core 31.

Before butting the two cores 31 as above, the coil winding 20 is retained on one core 31. At this time, leg portions 31*b* of the core 31 are in a state of being inserted into respective center holes 24 of the first winding part 21 and the second winding part 23 of the coil winding 20.

Thereafter, the other core 31 of the two cores 31 is butted against the one core 31. At this time, leg portions 31*b* of the other core 31 are in a state of being inserted into the respective center holes 24 of the first winding part 21 and the second winding part 23.

Then, the butted state of the one core 31 and the other core 31 is maintained. To maintain such a butted state, for example, an adhesive may be used to join butting faces of the cores 31 together, or the butted state of the cores 31 with each other may be maintained by any other joining means.

As described above, coil parts 10 as illustrated in FIG. 13 and FIG. 14 are produced. Note that the coil part 10A illustrated in FIG. 13 is one using the coil winding 20A illustrated in FIG. 6, and the coil part 10B illustrated in FIG. 14 is one using the coil winding 20B illustrated in FIG. 8.

<Effects>

Figure 15:
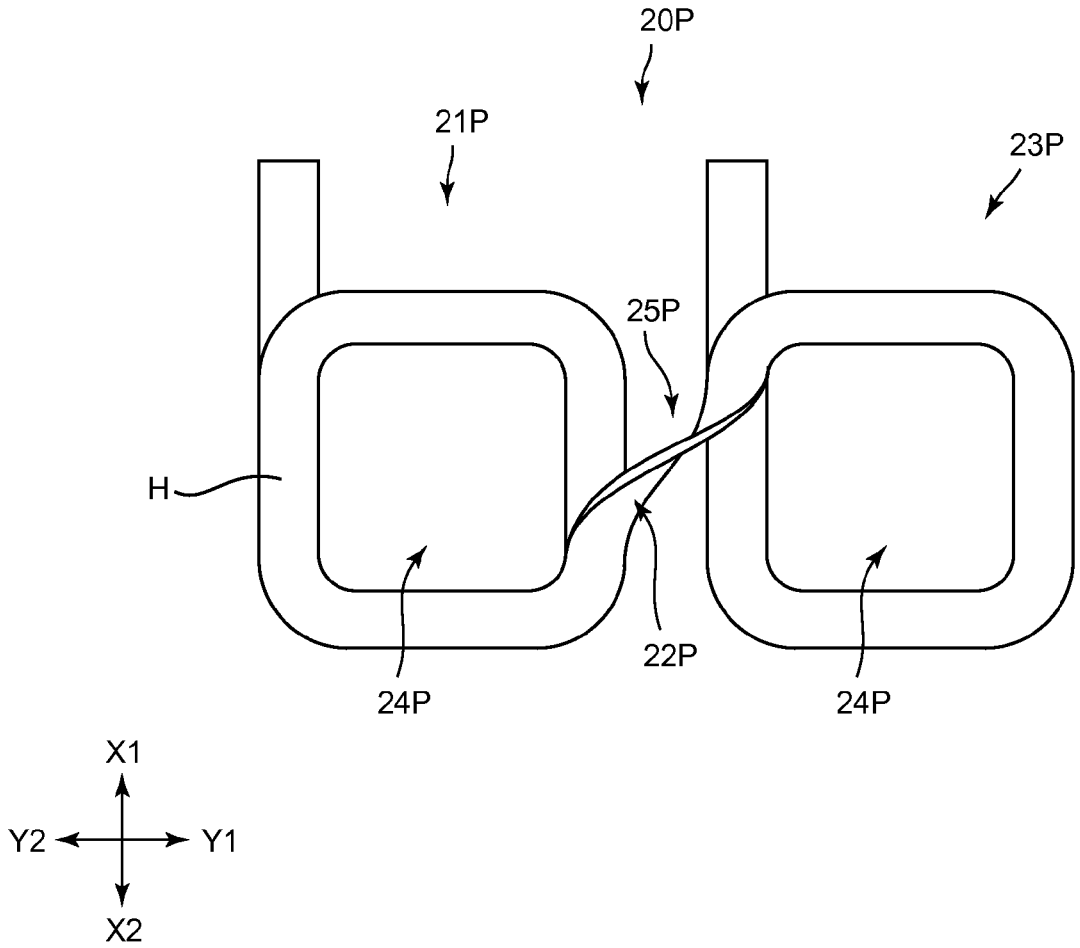
FIG. 15 is a plan view illustrating a structure of a conventional coil winding and illustrating a state that a twisted portion exists in a connecting wire part.
Figure 16:
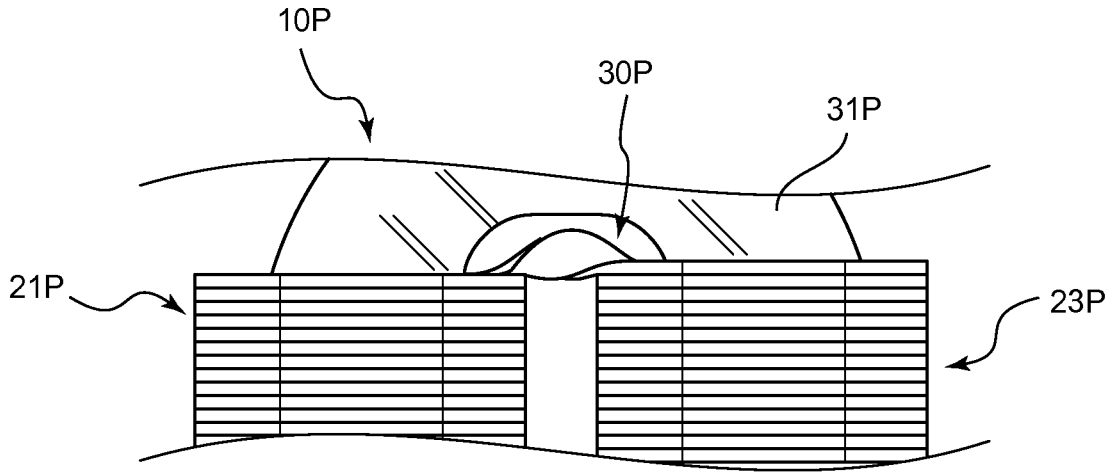
FIG. 16 is a partial side view illustrating the structure of the conventional coil part and is a view illustrating a structure in the vicinity of the twisted portion.

The winding structure 200, the coil winding 20, and the coil part 10 structured as above, and the manufacturing method of the coil winding 20 make it possible to prevent, when the connecting wire part 22 exists, enlargement of the ring hole 30A of the core body 30 due to the existence of the connecting wire part 22. That is, when the twisted portion 25P exists in a connecting wire part 22P connecting a first winding part 21P and a second winding part 23P as in the conventional coil winding 20P illustrated in FIG. 15, dimensions of the ring hole 30P become large so as to accommodate the twisted portion 25P as illustrated in FIG. 16. In this case, the largest length in the Z direction of the twisted portion 25P is approximately the same as the width of the flat wire H. Accordingly, an extra space is needed in the ring hole 30P, and the coil part 10P as the whole becomes large by the amount of the space.

Figure 13:
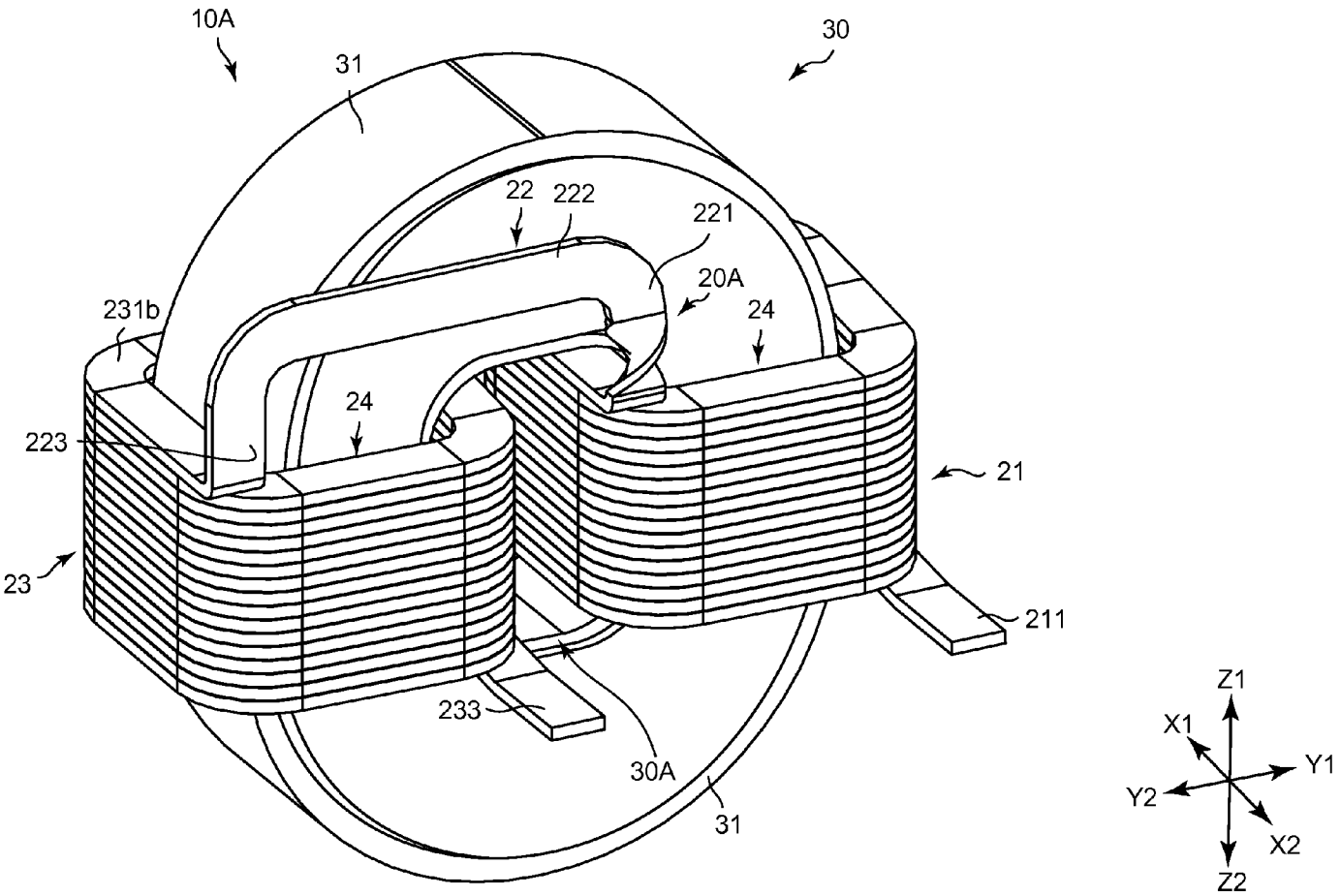
FIG. 13 is a perspective view illustrating a coil part produced using the coil winding illustrated in FIG. 6.
Figure 14:
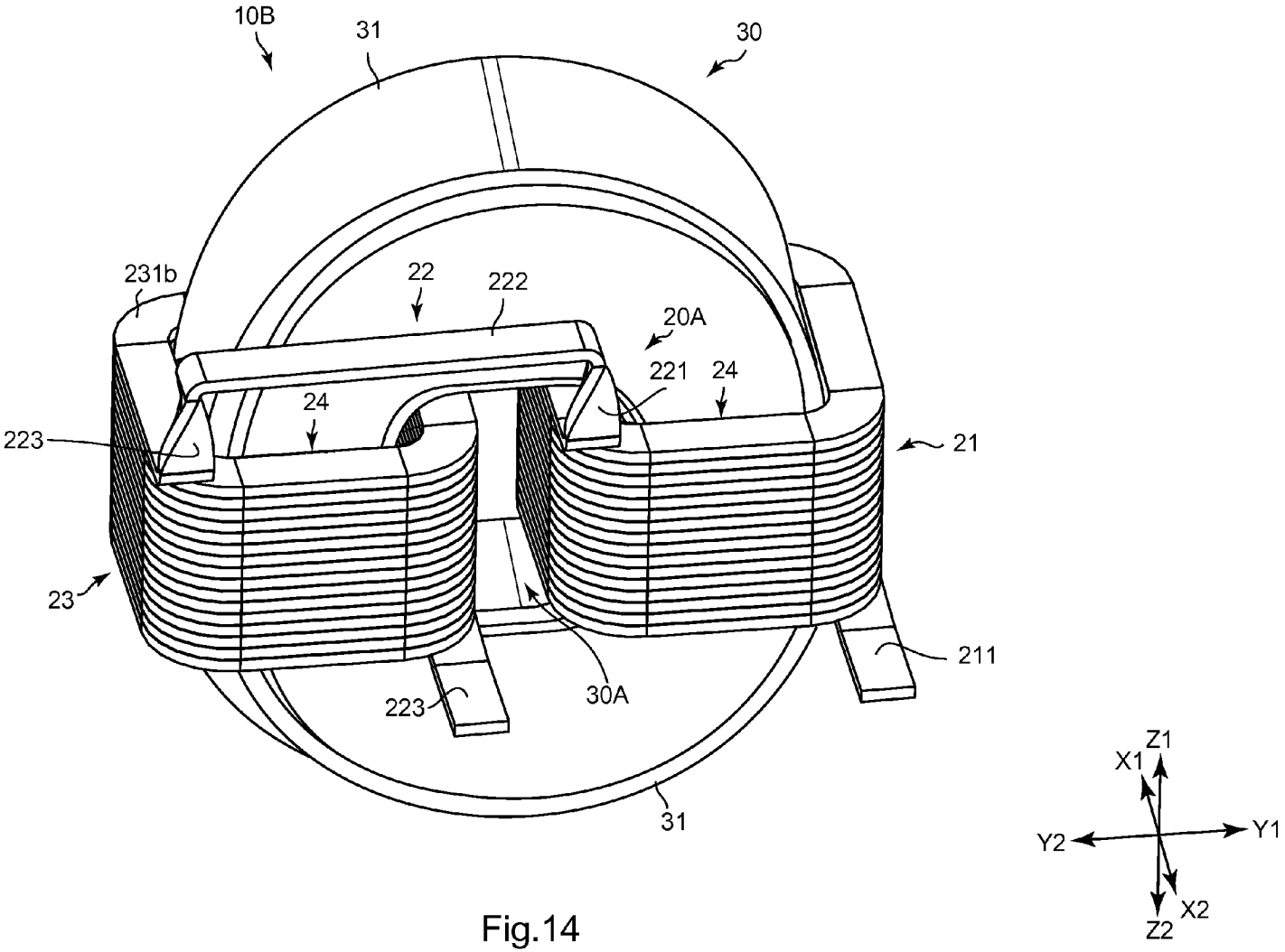
FIG. 14 is a perspective view illustrating a coil part produced using the coil winding illustrated in FIG. 8.

However, the above-described coil parts 10 illustrated in FIG. 13 and FIG. 14 have a structure in which the twisted portion 25P does not exist in the ring hole 30A. Thus, the extra space due to existence of the twisted portion 25P is not needed, and dimensions of the ring hole 30A can be made small. This allows reducing dimensions of the coil part 10.

Further, upon forming the connecting wire part 22, the winding structure 200 having the part to be connecting wire 22A as illustrated in FIG. 1 is used. Moreover, the part to be connecting wire 22A is provided with the first coupling portion 221 and the second coupling portion 223, and existence of the first coupling portion 221 and the second coupling portion 223 allows separating the interval defining portion 222 sufficiently from the first winding part 21 and the second winding part 23. Thus, the interval defining portion 222 is not located at a position of the ring hole 30A but can be located at a position separated from the ring hole 30A, allowing reduction of dimensions of the ring hole 30A. This allows reducing dimensions of the core body 30, and also allows reducing dimensions of the coil part 10. Further, a disposition not causing interference of the interval defining portion 222 with the core body 30 can be realized.

Further, in the coil winding 20A illustrated in FIG. 6, the first coupling portion 221 is twisted by approximately 180 degrees as illustrated in FIG. 6, and in the coil winding 20B illustrated in FIG. 8, two of the first coupling portion 221 and the second coupling portion 223 are twisted by approximately 180 degrees in total as illustrated in FIG. 8. Thus, even when the directions of edgewise bending of the first winding part 21 and the second winding part 23 are the same, it is possible to make the modes of winding of the first winding part 21 and the second winding part 23 similar. Specifically, in the first winding part 21, the first coupling portion 221 is located on the X2 side and the Y2 side in FIG. 6 and FIG. 8, and in the second winding part 23, similarly, the second coupling portion 223 is located on the X2 side and the Y2 side in FIG. 6 and FIG. 8. It is thus possible to realize similar modes of winding.

In addition, in this embodiment, it is also possible to make the numbers of windings of the first winding part 21 and the second winding part 23 equal. In this case, characteristics of the first winding part 21 and the second winding part 23 can be made equal. This can prevent occurrence of situations such as earlier magnetic saturation of one having a larger number of windings between the first winding part 21 and the second winding part 23.

Further, in the coil part 10 of this embodiment, a disposition is also possible such that the connecting wire part 22 is located within the range of seeing the first winding part 21 and the second winding part 23 of the coil winding 20 in a plan view. This allows realizing space reduction of the coil part 10.

Further, in the above-described embodiment, the directions of edgewise bending of the first winding part 21, the part to be connecting wire 22A, and the second winding part 23 are all the same in the winding structure 200. This facilitates formation of the winding structure 200. Here, when the directions of edgewise bending are in reverse, a labor such as changing the direction of setting the flat wire H so as to reverse a front side and a rear side occurs, and complication of the structure of the bending machine, and the like occur. However, since the directions of edgewise bending are all the same in the winding structure 200 as described above, it is possible to simplify labor during processing. Further, use of a bending machine having a complicated structure can be avoided.

Further, in the above-described embodiment, as illustrated in FIG. 6, the first coupling portion 221 and the second coupling portion 223 can be structured such that they continue to form the edgewise bending in the same direction as the winding direction of the first winding part 21 with respect to the interval defining portion 222, and the first coupling portion 221 becomes a twisted portion by twisting by approximately 180 degrees. When it is structured thus, after the winding structure 200A is formed, it is possible to reduce the number of times of bending the flat wire H. Further, the twisted portion is formed at only one position. This allows reducing the number of steps when the coil winding 20A and the coil part 10A are produced.

Moreover, in this embodiment, as illustrated in FIG. 9, the first coupling portion 221 and the second coupling portion 223 are in the same extending direction as the direction of the interval defining portion 222, and either of the first coupling portion 221 and the second coupling portion 223 can be structured to be a twisted portion by twisting by approximately 90 degrees each in the same direction. When it is structured thus, it is possible to provide the first coupling portion 221, the interval defining portion 222, and the second coupling portion 223 in a linear shape, thereby facilitating formation of the part to be connecting wire 22B.

Further, in this embodiment, as illustrated in FIG. 1 and FIG. 2, in the winding structure 200A, the terminal portion 211 on the side opposite to the first coupling portion 221 in the first winding part 21 and the terminal portion 233 on the side opposite to the second coupling portion 223 in the second winding part 23 have front end sides extending in the same direction (direction from X1 to X2). Thus, when the coil winding 20A as illustrated in FIG. 6 is formed using the winding structure 200A, it is possible to make the directions of the terminal portions 211, 233 the same. In addition, it is possible to separate the terminal portion 211 and the terminal portion 233 in the Y direction. This facilitates mounting of the coil part 10A, and allows preventing occurrence of short circuit between these terminal portions 211, 233 upon mounting.

Moreover, in this embodiment, as illustrated in FIG. 9, in the winding structure 200B, the terminal portion 211 and the terminal portion 233 have front end sides extending in opposite directions from each other. This makes it possible for the terminal portions 211, 233 to be in the same direction when the coil winding 20B as illustrated in FIG. 8 is formed using the winding structure 200B. In addition, it is possible to separate the terminal portion 211 and the terminal portion 233 in the Y direction. This facilitates mounting of the coil part 10B, and allows preventing occurrence of short circuit between these terminal portions 211, 233 upon mounting.

Further, in this embodiment, as illustrated in FIG. 6, when the coil winding 20A is formed, the boundary portion between the first coupling portion 221 and the first winding part 21 is bent so that the first coupling portion 221 extends in a direction to depart from the first winding part 21 (Z direction). In addition, the boundary portion between the second coupling portion 223 and the second winding part 23 is bent so that the second coupling portion 223 extends in a direction to depart from the second winding part 23 (Z direction). Then, the connecting wire part 22 is formed from the part to be connecting wire 22A by the bending of the boundary portions. Thus, by performing the bending as described above, the interval defining portion 222 can be positioned on the Z1 side of the straight portion 213*d*, and hence a disposition not causing interference with the core 31 can be realized.

Further, in this embodiment, as illustrated in FIG. 8, the boundary portion between the first coupling portion 221 and the first winding part 21 is bent so that the first coupling portion 221 extends in the Z direction, and likewise the boundary portion between the second coupling portion 223 and the second winding part 23 is bent so that the second coupling portion 223 extends in the Z direction. In addition, the boundary portion between the first coupling portion 221 and the interval defining portion 222 and the boundary portion between the second coupling portion 223 and the interval defining portion 222 are bent so that the first winding part 21 and the second winding part 23 are located on the same side of the axial direction, and the connecting wire part 22 is formed from the part to be connecting wire 22A by the bending of the boundary portions. Thus, the connecting wire part 22 can be formed by performing bending and twisting of the part to be connecting wire 22A. In addition, when twisting is performed, the angle of twisting can be distributed to the first coupling portion 221 and the second coupling portion 223. Thus, even when dimensions of the first coupling portion 221 and the second coupling portion 223 are short, sufficient twisting is possible.

<Modification Example>

The winding structure 200, the coil winding 20, the coil part 10, and the manufacturing method of the coil winding 20 according to one embodiment of the present invention have been described above. Besides them, the present invention can be modified in various ways. Such modifications will be described below.

In the above-described embodiment, the first winding part 21 and the second winding part 23 are wound in a rectangular shape. However, the first winding part 21 and the second winding part 23 are not limited to the structure of being wound in a rectangular shape, and may be wound in a different shape, such as a circle, an ellipse, or a polygon such as a triangle.

Further, in the above-described embodiment, as illustrated in FIG. 6, the case where the twisted portion is formed in the first coupling portion 221 is described. However, the twisted portion may be formed in the second coupling portion 223 as in a coil winding 20C illustrated in FIG. 17. When it is formed thus, functions equivalent to those of the coil winding 20A illustrated in FIG. 6 can be exhibited.

Figure 17:
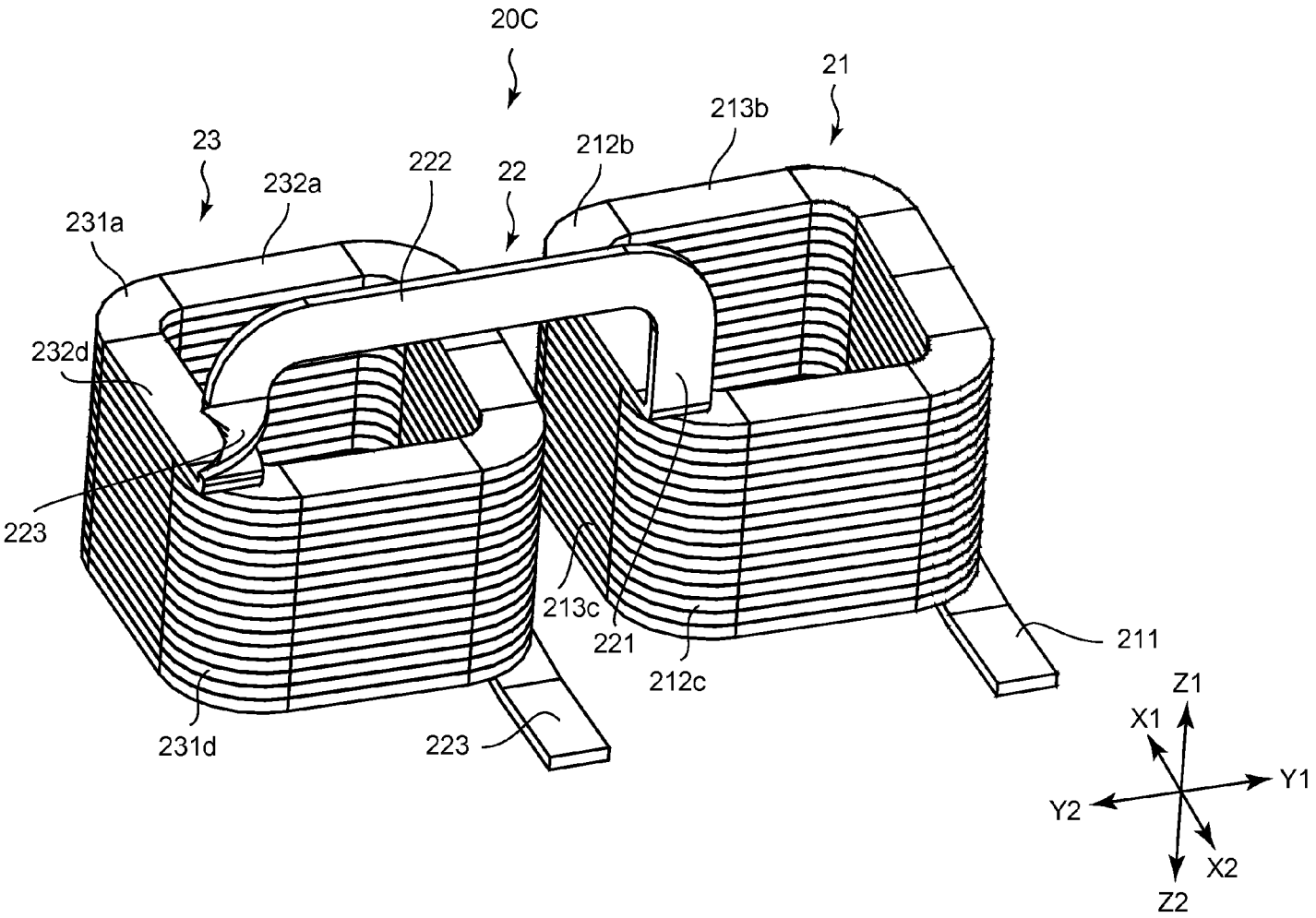
FIG. 17 is a view illustrating a modification example of the coil winding illustrated in FIG. 6 and is a perspective view illustrating a state that a twisted portion is formed in the second coupling portion.

Note that when the coil winding 20 as illustrated in FIG. 17 is formed, the direction of edgewise bending of the connecting wire part 22 is different from the directions of the first winding part 21 and the second winding part 23. However, even with the structure as in FIG. 17, it is possible to make a structure such that the interval defining portion 222 is not located in the ring hole 30A of the core body 30. An extra space due to existence of the twisted portion becomes unnecessary, and dimensions of the ring hole 30A can be made small. Thus, it is possible to reduce dimensions of the coil part 10.

Figure 18:
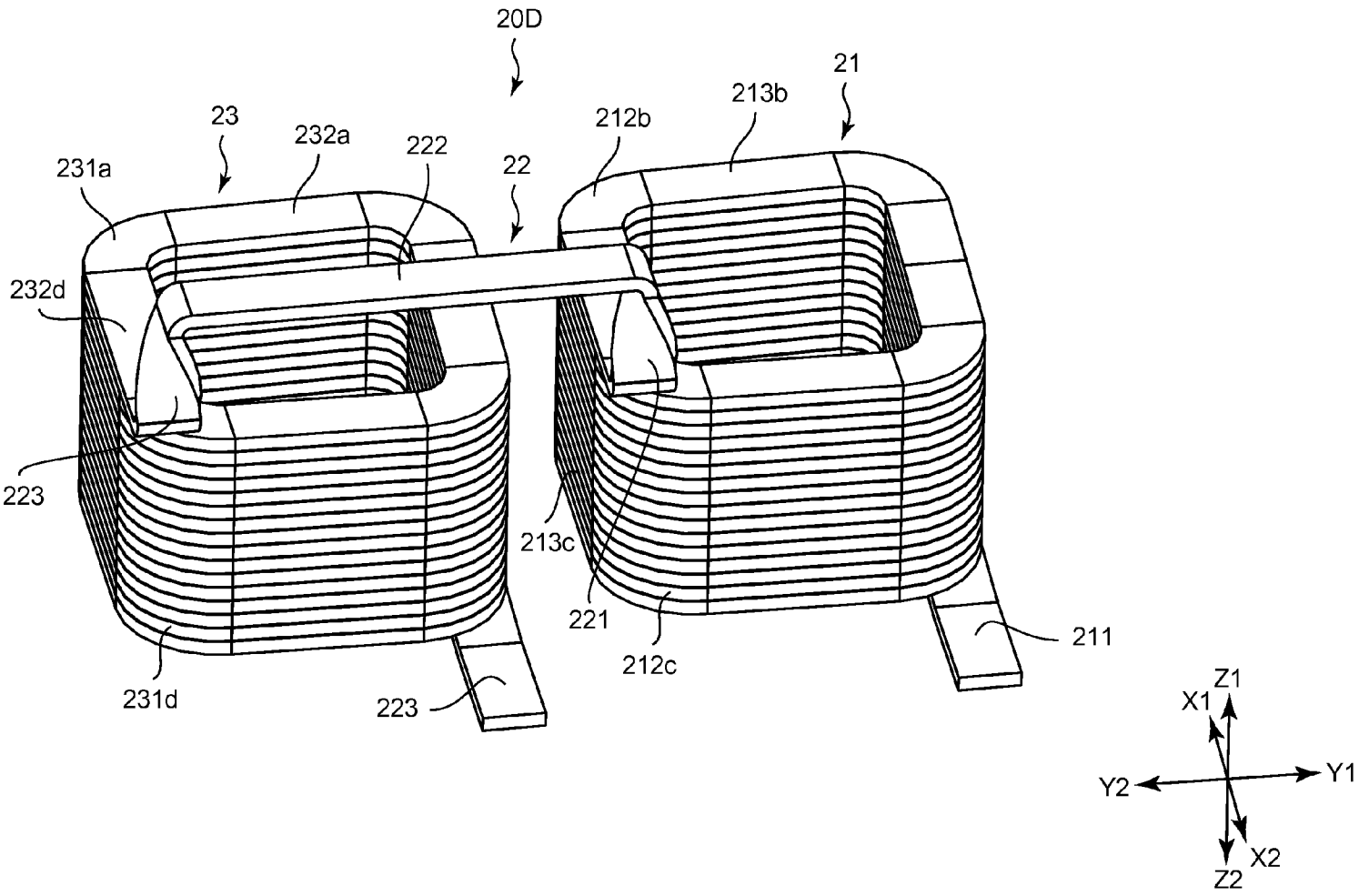
FIG. 18 is a view illustrating a modification example of the coil winding illustrated in FIG. 8 and is a perspective view illustrating a state that the direction of twisting by approximately 90 degrees in the first coupling portion and the second coupling portion is inverted from that of FIG. 8.

Further, in the above-described embodiment, as illustrated in FIG. 10A, the first coupling portion 221 in the part to be connecting wire 22B is twisted in a direction to position the second winding part 23 on the Y2 side with respect to the position before it is twisted. However, the direction to twist the first coupling portion 221 by approximately 90 degrees illustrated in FIG. 10A and the direction to twist the second coupling portion 223 by approximately 90 degrees illustrated in FIG. 10B may be opposite directions. In this case, by further performing bending in the same direction as in FIGS. 11A, 11B, a coil winding 20D as illustrated in FIG. 18 can be formed. In the coil winding 20D illustrated in FIG. 18, the direction to twist the first coupling portion 221 and the second coupling portion 223 by approximately 90 degrees is opposite to that illustrated in FIG. 8.

Note that in the coil winding 20D illustrated in FIG. 18, bending of the boundary portion between the first coupling portion 221 and the interval defining portion 222 may be, inversely to FIG. 11A, bending of the boundary portion so that the second winding part 23 turns counterclockwise with respect to the first winding part 21. At this time, bending of the boundary portion between the second coupling portion 223 and the interval defining portion 222 is, inversely to FIG. 11B, bending of the boundary portion so that the second winding part 23 turns counterclockwise with respect to the first winding part 21. When such bending is performed, positions of the first winding part 21 and the second winding part 23 are inverted left to right from those illustrated in FIG. 8. However, it is possible to form a coil winding 20 with the other structures being similar to the coil winding 20B.

Further, in the above-described coil windings 20A to 20D illustrated in FIG. 6, FIG. 8, FIG. 17, and FIG. 18, the boundary portion between the first coupling portion 221 and the first winding part 21 and the boundary portion between the second coupling portion 223 and the second winding part 23 are bent by approximately 90 degrees. However, the angle of bending is not limited to approximately 90 degrees, and it may be oblique bending. In the case of oblique bending, it is possible to secure a large space between the interval defining portion 222 and the core body 30.

The winding structure, the coil winding, the coil part, and the coil winding manufacturing method of the present invention can be used in the field of electric equipment.

DESCRIPTION OF REFERENCE NUMERALS

10, 10A, 10B . . . coil part
20, 20A to 20D, 20P . . . coil winding
21, 21P . . . first winding part
22, 22P . . . connecting wire part
22A, 22B . . . part to be connecting wire
23, 23P . . . second winding part
24 . . . center hole
25P . . . twisted portion
30 . . . core body
30A, 30P . . . ring hole
31 . . . core
31*a* . . . cutout part
31*b* . . . leg portion
200, 200A, 200B . . . winding structure
211 . . . terminal portion (corresponding to first terminal)
212*a* to 212*d* . . . bent portion
213*a* to 213*d* . . . straight portion
221 . . . first coupling portion
222 . . . interval defining portion, 223 . . . second coupling portion
231*a* to 231*d* . . . bent portion
233 . . . terminal portion (corresponding to second terminal)
H . . . flat wire
M . . . bending part
P . . . processing unit
P1 . . . inner jig
P2 . . . outer jig

What is claimed is:

1. A coil winding, comprising:

a first winding part formed by winding a flat wire;

a second winding part formed by winding the flat wire continuing to the first winding part, the second winding part being wound in a same winding direction as a winding direction of the first winding part; and a connecting wire part located between the first winding part and the second winding part to connect the winding parts, wherein the connecting wire part has:

an interval defining portion defining an interval between the first winding part and the second winding part;

a first coupling portion with one end side continuing to the interval defining portion and another end side continuing to the first winding part on one side in a first axial that is an axial direction of the first winding part; and a second coupling portion with one end side continuing to the interval defining portion and another end side continuing to the second winding part on another side in a second axial that is an axial direction of the second winding part, at least one of the first coupling portion and the second coupling portion becomes a twisted portion by twisting by approximately 180 degrees in total, and a boundary portion between the first coupling portion and the first winding part is bent so that the first coupling portion extends in the first axial direction to depart from the first winding part, and a boundary portion between the second coupling portion and the second winding part is bent so that the second coupling portion extends in the second axial direction to depart from the second winding part.

2. The coil winding according to claim 1, wherein numbers of windings of the first winding part and the second winding part are equal.

3. The coil winding according to claim 1, wherein the first coupling portion and the second coupling portion continue to the interval defining portion by forming an edgewise bending in a same direction as a winding direction of the first winding part, and either one of the first coupling portion and the second coupling portion is provided with a twisted portion by twisting by approximately 180 degrees.

4. The coil winding according to claim 1, wherein extending directions of the first coupling portion and the second coupling portion are same as an extending direction of the interval defining portion, and both the first coupling portion and the second coupling portion are provided with twisted portions by twisting each by approximately 90 degrees in a same direction.

5. The coil winding according to claim 3, wherein a first terminal on a side opposite to the first coupling portion in the first winding part and a second terminal on a side opposite to the second coupling portion in the second winding part have front end sides extending in a same direction.

6. The coil winding according to claim 4, wherein a first terminal on a side opposite to the connecting wire part in the first winding part and a second terminal on a side opposite to the connecting wire part in the second winding part have front end sides extending in opposite directions from each other.

7. A coil winding according to claim 4, wherein a boundary portion between the first coupling portion and the interval defining portion and a boundary portion between the second coupling portion and the interval defining portion are bent so that the first winding part and the second winding part are located on a same side in the axial direction.

8. The coil winding according to claim 1, wherein a first terminal on a side opposite to the connecting wire part in the first winding part and a second terminal on a side opposite to the connecting wire part in the second winding part have front end sides extending in a same direction, and one of the first terminal and the second terminal is located on an facing portion side where the first winding part and the second winding part face each other, and the other of the first terminal and the second terminal is located on an outer peripheral side where the first winding part and the second winding part do not face each other.

9. A coil part, comprising:

the coil winding according to claim 1; and a core body formed from a magnetic material, provided in a ring shape, and inserted through a center hole of the first winding part and a center hole of the second winding part.

* * * * *